United States Patent [19]

Hiroya et al.

[11] 4,309,191

[45] Jan. 5, 1982

[54] COAL-OIL MIXTURE

[75] Inventors: Osamu Hiroya; Hiroyuki Ihara, both of Yokohama; Yoshitomo Sanami, Kamakura, all of Japan

[73] Assignee: Mitsubishi Oil Co., Ltd., Tokyo, Japan

[21] Appl. No.: 184,566

[22] Filed: Sep. 5, 1980

[30] Foreign Application Priority Data

Sep. 5, 1979 [JP] Japan ..... 54/112785
Sep. 5, 1979 [JP] Japan ..... 54/112786

[51] Int. Cl.[3] ..... C10L 1/32

[52] U.S. Cl. ..... 44/51; 208/8 R; 208/8 LE; 208/16

[58] Field of Search ..... 44/51; 208/8 R, 8 LE, 208/16

[56] References Cited

U.S. PATENT DOCUMENTS

| | | | |
|---|---|---|---|
| 3,764,547 | 10/1973 | Schlinger et al. | 44/51 |
| 4,069,022 | 1/1978 | Metzger | 44/51 |
| 4,089,657 | 5/1978 | Keller | 44/51 |
| 4,130,400 | 12/1978 | Meyer | 44/51 |

*Primary Examiner*—Jacqueline V. Howard
*Attorney, Agent, or Firm*—Sughrue, Mion, Zinn, Macpeak & Seas

[57] ABSTRACT

A coal-oil mixture comprising pulverized coal dispersed in hydrocarbon oil containing olefinic hydrocarbons having at least 8 carbon atoms in an amount of at least 5% by volume, based on the total volumes of the hydrocarbon oil and the olefin.

17 Claims, No Drawings

COAL-OIL MIXTURE

BACKGROUND OF THE INVENTION

1. Field of the Invention

The present invention relates to coal-oil mixtures (that is, mixtures of coal dispersed in oil) having excellent stability comprising mixtures of pulverized coal and hydrocarbon oil wherein the pulverized coal contained therein does not precipitate or solidify even after long periods of time.

2. Description of the Prior Art

Hitherto, solid coal has been considered inferior as an energy source to liquid fuel oil because of difficulties of transportation, storage, combustion control, and so forth. In order to overcome these defects and to increase the utility of coal as a fuel, various studies have been conducted concerning so-called coal-oil mixtures (hereinafter referred to as "COMs"), which is prepared by pulverizing the coal and dispersing it in fuel oil. As published in the First International Symposium on Coal Oil Mixture Combustion, held at Florida in the United States in May, 1978, COM is generally prepared by by mixing a petroleum fuel oil with a pulverized coal in an amount of about 20 to 70% by weight of COM. That is, when the pulverized coal content is less than 20% by weight, a use of coal as energy source is insufficient and when the pulverized coal content is more than 70% by weight, the viscosity of the coal-oil mixture is remarkably increased and the fluidity thereof is reduced. In Japan, studies concerning such so-called colloidal fuel similar to COM, prepared by pulverizing coal and mixing it with oil, had been actively conducted by the KAIGUN NENRYOSHO (Naval Fuelyard), etc., before World War II. However, when pulverized coal having a common particle size for conventional direct combustion facilities was merely mixed with petroleum fuel oil, the coal particles separated by precipitation to form a nonfluid solid layer because of differences in the specific gravity of the coal and oil. In order to prevent this phenomenon, the possibility of continuous agitation has been studied as well as the possibility of reducing the precipitation rate of the coal particles by reducing the particle diameter of all of the coal particles to less than 10μ. However, such techniques are expensive and are not preferred for practical use.

On the other hand, studies have also been conducted concerning a method of producing a stabilized or emulsified COM by techniques comprising adding a stabilizing agent, such as a high molecular material or an emulsifying agent, etc., and/or water to the petroleum fuel oil and pulverized coal, in order to prevent precipitation of the pulverized coal. Typical stabilizing agents used for the above-described purpose include, for example, protective colloids such as glue, gelatin, gum arabic or starch, etc. In addition, other materials that can be used include paraffin, sericin, lanolin, vaseline, and analogues thereof, such as wax, beef tallow or wool grease, etc. However, these aforementioned stabilizing agents are not absolutely effective, although they do exhibit some degree of stabilizing function.

Other materials that have been proposed include metal soaps of aliphatic acids. As the metal of these metal soaps, Al, Mn, Co, Zn, Ca, Na, K, Pb and Mg have been used. As the aliphatic acids, oleic acid, stearic acid and palmitic acid have been used. In addition, many other studies have also been reported. For example, studies have been made of a process for preventing precipitation of coal particles which comprises adding alkali to form a salt of humic acid in coal, and of a process for producing stabilized COM which comprises adding a suitable amount of oil derived from coal, for example, tar oil containing anthracene, naphthalene, phenanthrene or phenol, etc., anthracene oil and creosote oil, etc., to the mixture in order to disperse the coal particles by deflocculation. The general statements of the above-described studies are reported in *Sekitan No Yōkai To Kōshitsu-Nenryō* (The dissolution of a coal and the colloidal fuel) written by Yasutaro Miyazaki, 1940.

In recent times, control of production and high prices charged by countries having petroleum oil resources in the Middle and Near East have caused the occurrence of an energy crisis. Taking this opportunity, diversion of energy resources away from oil has been required throughout the world, and an energy demand structure comprising petroleum fuel oil as the principal energy source has had to be reexamined.

Therefore, COM has been noticed again in relationship to the consumption and economy of petroleum oil resources, and the effective use of coal, and many studies and inventions have been proposed.

Among these proposed studies, there are certain inventions concerning processes for producing stabilized COM without using a stabilizing agent, such as: a process which comprises applying an electric field to a fuel oil dispersion system containing pulverlized coal to reduce the precipitation rate of pulverlized coal caused by increasing in viscosity by an electroviscous effect, as described in U.S. Pat. No. 4,202,670; and a process which comprises incorporating about 3% of superpulverized coal having a particle diameter of 5μ or less in the pulverized coal in order to prevent contact of large particles and thereby prevent formation of a dense precipitate, as described in Japanese Patent Application (OPI) No. 40808/79 (the term "OPI" as used herein refers to a "published unexamined Japanese patent application") filed by the present inventors. However, in the majority of these studies stabilizing agents for the COMs are used, for example, in Japanese Patent Application (OPI) No. 18604/78, the nonionic surface active agents having the value of HLB (Hydrophile Lipophile Balance) of 17 to 20 and water-soluble organic polymers are used as stabilizing agents for the COMs. Thus, the majority of the conventional studies relates to the stabilizing agents used.

Addition of a large amount of the stabilizing agent generally improves the stability of COMs, but it also causes increases in the cost thereof. Therefore, it has been desired to develop stabilizing agents having a sufficient stabilizing function even if added to a COM in an extremely small amount.

Various kinds of additives, for example, various imidazoline type surface active agents, bisamide compounds, ether amine derivatives, alkylphenol type surface active agents, the above-described metal soaps, metal salts of carboxyl group containing hydrocarbons, polyethylene glycol type nonionic surface active agents, alkylene oxide derivatives having active hydrogen, alkylarylsulfonic acid type anionic surface active agents and salts of dialkylsulfosuccinic acid ester, etc., have been proposed heretofore. However, stabilizing agents having further improved properties have been desired.

The past studies have concentrated attention on the coal particles as a dispersoid, and the development of stabilizing agents therefor, and the characteristics of hydrocarbon fuel oil as a dispersion medium have not been studied so extensively.

In general, hydrocarbons are divided, roughly, into the types of paraffinic, olefinic, naphthenic and aromatic.

The paraffinic hydrocarbons are saturated chain compounds represented by the molecular formula $C_nH_{2n+2}$ (wherein n is a positive integer), and include n-paraffins having no branches and isoparaffins having branches. In petroleum light fractions, the content of paraffinic hydrocarbons is comparatively large.

The olefinic hydrocarbons are unsaturated chain hydrocarbons having one or more double bonds represented by, for example, the general formula $C_nH_{2n}$ (wherein n is a positive integer) in the case of such compounds having one double bond. Such olefins are not present in appreciable amounts in crude petroleum oil. Petroleum products excepting gasoline contain only very small amount of olefins. Hitherto, the petroleum fuel oils used for COMs contain olefins in the very small amount of 1% by volume or less, which does not contribute to the stability of COMs. Further, diolefins and cyclic olefins are present, if at all, only in minute in petroleum products.

The naphthenic hydrocarbons are hydrocarbons having at least one saturated ring in the molecule. The naphthenic hydrocarbons contained in crude oil or petroleum products are typically those in which two or three naphthenic groups are linked-to one another or condensed with aromatic rings or those which have naphthenic rings or condensed rings having paraffin side chains.

Aromatic hydrocarbons have at least one aromatic ring in the molecule. In light petroleum fractions, benzene and mononuclear compounds having side chains on the benzene ring are the main aromatic components. In heavy petroleum fractions, polynuclear condensed aromatic compounds such as binuclear or trinuclear compounds and compounds containing both of a benzene ring and a naphthene ring are contained as the main aromatic components.

The petroleum fuel oils such as crude oil used as a fuel at present, kerosene (JIS K2203-1972), gas oil (JIS K2204-1976), A-type fuel oil (JIS K2205-1960), B-type fuel oil (JIS K2205-1960), and C-type fuel oil (JIS K2205-1960), etc., are composed mainly of paraffinic hydrocarbons, naphthenic hydrocarbons and aromatic hydrocarbons, and contain only very small amounts of olefinic hydrocarbons.

Moreover, petroleum crude oil or petroleum fuel oil generally contains no appreciable amounts of organic oxygen, if contained, 0.05 wt% or less. For example, the organic oxygen compounds are phenols, naphthenic acid, fatty acids, etc. On the contrary it has been reported by the present inventor in Japanese Patent Application (OPI) No. 129008/79 that oxidized oil of the aromatic hydrocarbon fractions having a boiling point of 200° C. or more showed an excellent effect as a stabilizing agent for the COM. On the other hand, in accordance with the present invention, it has been found that the COM having an excellent stability can be obtained when the above-described oxidized oil is used as a stabilizing agent in the hydrocarbon oils containing at least 5% by volume of olefinic hydrocarbons having at least 8 carbon atoms.

SUMMARY OF THE INVENTION

Considering the above-described facts, extensive experiments have been conducted preparing various hydrocarbon oils having novel compositions from petroleum fuel oil. As a result of studies on the stability of COMs prepared using these novel hydrocarbon oils, it has now been found that remarkably stabilized COM can be obtained without using expensive additives such as surface active agents, when hydrocarbon oil having the following composition is mixed with pulverized coal.

Namely, it has been found that COMs having excellent stability can be obtained by using hydrocarbon oil containing olefinic hydrocarbons in an amount of at least 5% by volume, based on the total volumes of the hydrocarbon oil and the olefin.

Also, as a result of other studies relating to organic oxygen compounds, it has been found that organic oxygen compounds having a carbonyl group which show a strong absorption in 1,630 to 1,750 $cm^{-1}$ of the infrared absorption spectrum, for example, organic acids, ketones, aldehydes, acid amides, acid imides and acid thiols, etc., are particularly effective, and that remarkably stabilized COM can be obtained when hydrocarbon oil containing at least 0.5% by weight of the organic oxygen and at least 5% by volume of olefinic hydrocarbons having at least 8 carbon atoms is mixed with pulverized coal.

Since olefinic hydrocarbons easily undergo oxidation, it is possible according to another embodiment of the invention to effectively oxidize a part of hydrocarbon oil containing the olefinic hydrocarbons by oxidation to form carbonyl groups, by which the organic oxygen compounds resulting and the unreacted olefinic hydrocarbons can be utilized in the present invention.

DETAILED DESCRIPTION OF THE INVENTION

As the hydrocarbon oil, it is possible to use hydrocarbon oil prepared by adding olefinic hydrocarbons to a petroleum fuel oil not containing olefinic hydrocarbons such as has been conventionally used for COMs and a hydrocarbon oil containing olefinic hydrocarbons. The content of the above mentioned olefinic hydrocarbon is in an amount of at least 5% by volume, based on the total volumes of the petroleum fuel oil or the hydrocarbon oil and the olefin added or contained.

It is possible to use petroleum fuel oils prepared by adding olefinic hydrocarbons in an amount of at least 5% by volume based on the total volumes of the petroleum fuel oil and the olefin, to petroleum fuel oil, as examples of the former, and cracked or reformed oils of heavy hydrocarbon oil from petroleum, coal, oil sand or oil shale and liquid oils obtained from oil shale, as examples of the latter.

Further according to the present invention, COMs having excellent stability can be obtained using the following hydrocarbon oils which contain organic oxygen:

(1) Oils obtained by adding olefinic hydrocarbons having at least 8 carbon atoms and organic oxygen compounds to a petroleum fuel oil which does not contain olefinic hydrocarbons.

(2) Oils obtained by adding organic oxygen compounds to a hydrocarbon oil containing olefinic hydrocarbons having at least 8 carbon atoms.

(3) Oils obtained by partially oxidizing liquid oil containing olefinic hydrocarbons having at least 8 carbon atoms which are easily oxidizable.

(4) Hydrocarbon oils containing olefinic hydrocarbons having at least 8 carbon atoms and organic oxygen compounds.

Petroleum fuel oils which can be used in this invention include those which are liquid at room temperature, for example, petroleum crude oil, topped crude oil obtained by cutting off a gasoline fraction from petroleum crude oil, atmospheric residual oil, kerosene (JIS K2203-1972), gas oil (JIS K2204-1976), A-type fuel oil (JIS K2205-1960), B-type fuel oil (JIS K2205-1960), and C-type fuel oil (JIS K2205-1960), etc.

As the olefinic hydrocarbons which can be added to the petroleum fuel oil in the present invention, those having at least 8 carbon atoms, preferably 10 or more carbon atoms, of an initial boiling point higher than 150° C. are required. Examples thereof include decene, undecene and dodecene, and so forth.

In addition, it is possible to use liquid oils containing a comparatively large amount of olefinic hydrocarbons, for example, liquid oils obtained by processes such as cracking, reforming or pyrolysis, etc., of heavy hydrocarbons from petroleum oil, oil sand, oil shale or coal.

The amount of olefinic hydrocarbons added to the petroleum fuel oil should be at least 5% by volume and preferably is at least 10% by volume, based on the total volumes of the petroleum fuel oil and the olefin, with respect to the viewpoint of contribution to the stability of the COM.

There is no upper limit on the amount of olefinic hydrocarbons. If necessary, for example, the olefinic hydrocarbons can be used in an amount of 60% by volume while the petroleum fuel oil is 40% by volume.

With respect to the organic oxygen compounds that can be used in the oils (1) and (2) described above, compounds, having a carbonyl group, for example, organic acids, esters, aldehydes, ketones, acid amides, acid imides and acid thiols, etc., are preferred, although ethers, alcohols and phenols may also be used. The organic oxygen content in the petroleum fuel oil is preferred to be at least 0.5% by weight from the viewpoint of contribution thereof to stability of the COM.

Examples of the heavy oils which can be cracked or reformed according to the invention include heavy petroleum oil fractions such as vacuum residue, etc. and heavy oil from coal, oil sand and oil shale. In one embodiment of the invention, these can be utilized as the hydrocarbon oil in the invention by adding an organic oxygen compound thereto.

Processes for cracking or reforming include, for example, thermal cracking, steam cracking or catalytic cracking, etc. Since oils obtained by cracking or reforming these heavy oils generally contain at least 5% by volume, preferably at least 10% by volume, olefinic hydrocarbons, they can generally be used directly as the hydrocarbon oil for a COM according to the present invention.

Examples of the liquid oil containing olefinic hydrocarbons that can be used as described in (3) above include, for example, oils obtained by adding oxidizable olefinic hydrocarbons such as 1-dodecene, to petroleum fuel oil, and to various liquid oils containing olefinic hydrocarbons as described in (2). These liquid oils containing olefinic hydrocarbons can be utilized as the hydrocarbon oil in the present invention by oxidizing a part of them.

Furthermore, oil obtained by pyrolysis (retorting) of oil shale and light oil or heavy oil obtained by fractional distillation thereof can be used directly as the hydrocarbon oil for COMs according to the present invention, and exemplify hydrocarbon oils of as in (4) described above, since they generally contain at least 20% by volume olefinic hydrocarbons and at least 0.5% by weight organic oxygen.

The exact mechanism of how the olefinic hydrocarbons and organic oxygen compounds in the hydrocarbon oil contribute to stabilization of the COM is not fully understood. However, it is supposed that, since olefinic hydrocarbons have a large polarity than saturated hydrocarbons, they may be selectively adsorbed in the surface of pulverized coal and, consequently, aggregation and solidification of the pulverized coal particles are prevented, to thereby produce stabilized COM. Also, the organic oxygen compounds are believed to be easily adsorbed in the surface of pulverized coal particles by hydrogen bonds, because of having hydrophilic groups and polarity and, consequently, they show a cooperative effect in coexistence with the olefinic hydrocarbons to obtain further stabilized COMs. Particularly, the organic compounds having a carbonyl group are believed to have a large effect due to the above-described adsorption.

In order to carry out quantitative analysis of the organic oxygen, the present inventors have made calibration curves which show each a relation between absorption strength and content in each absorption band, using infrared spectra, and have attempted to carry out quantitative analysis.

For example, absorption spectrum concerning the organic oxygen shows the OH group in 3,200 to 3,600 $cm^{-1}$ or the carbonyl group such as ketone, aldehyde, carboxylic acid, amide, imide or thiol thereof in 1,630 to 1,750 $cm^{-1}$, and these absorption peaks can be suitably utilized for quantitative analysis.

Further, in order to improve stability, it is possible to add, if desired, a very small amount of various kinds of stabilizing agents such as cationic, anionic or nonionic surface active agents, various polymers, etc., to the above-described COM as a stabilizer.

The pulverized coal used in this invention is generally composed of finely pulverized coal (the term "coal" as used herein includes substances such as petroleum coke) having an average particle diameter of 100μ or less, e.g., from 50μ to 100μ, 80% or more of which particles pass through a Tyler 100 mesh sieve.

Further, in the case of obtaining an emulsified COM using various hydrocarbon oils in the present invention, from 2 to 100 parts of water can be added per 100 parts by volume of the hydrocarbon oil to form the emulsion, adding, if necessary, an emulsifying agent, and the pulverized coal is then dispersed in the resulted emulsion. Emulsified COM is advantageously used from the viewpoint of air pollution, because the nitrogen oxide content in exhaust gas therefrom is very small. However, if water is used in an amount of less than 2 parts by volume, the effect of reducing the nitrogen oxide content is not substantially obtained. If the water is used in an amount of more than 100 parts by volume, the stability of the emulsified COM is adversely affected.

Moreover, if an emulsifying agent is used for producing the emulsified oil by mixing water with the hydrocarbon oil, a further stabilized emulsified oil can be obtained, by which the stability of the emulsified COM can be improved. Known synthetic surface active agents and natural surface active agents may be used as the emulsifying agent. In addition, known anti-freezing agents, rust inhibitors and antifungal agents may be included in COMs according to this invention.

The present invention is hereinafter illustrated with reference to examples, but the present invention is not intended to be limited by these examples.

In the following examples, coals as shown in Table 1, petroleum fuel oils as shown in Table 2 and heavy cracking oil and shale oil as shown in Tables 3 and 4 were used.

TABLE 1

| | Coal (brown coal) | Coal (bituminous coal) | Petroleum Coke (delayed coke) |
|---|---|---|---|
| Specific Gravity | 1.35 | 1.39 | 1.32 |
| Elementary Analysis | | | |
| Carbon wt% | 69.0 | 73.0 | 84.0 |
| Hydrogen wt % | 5.0 | 5.0 | 4.0 |
| Oxygen wt % | 6.5 | 5.0 | 6.9 |
| Nitrogen wt % | 2.0 | 1.0 | 2.5 |
| Sulfur wt % | 0.5 | 1.4 | 1.5 |
| Proximate Analysis | | | |
| Moisture wt % | 2.5 | 2.5 | 2.3 |
| Ash wt % | 14.5 | 12.5 | 1.0 |
| Volatile matter wt % | 42.0 | 33.0 | 9.4 |
| Fixed carbon wt % | 41.0 | 52.0 | 87.3 |
| Distribution of Particle size (wt %) | | | |
| Tyler: more than 100 mesh | 5.0 | 16.2 | 5.0 |
| 100–200 mesh | 15.0 | 19.0 | 15.0 |
| less than 200 mesh | 80.0 | 64.8 | 85.0 |

TABLE 2

| | A-type fuel oil | Topped crude oil of Iran heavy crude oil* |
|---|---|---|
| Specific Gravity, 15/4° C. | 0.839 | 0.899 |
| Elementary Analysis | | |
| Carbon wt % | 86.2 | 85.4 |
| Hydrogen wt % | 13.1 | 12.4 |
| Oxygen wt % | 0 | 0 |
| Nitrogen wt % | 0 | 0.2 |
| Sulfur wt % | 0.7 | 2.0 |
| Composition of Hydrocarbon | | |
| Paraffin vol % / Naphthene vol % | 75 | 70 |
| Olefin vol % | 0 | 0 |
| Aromatics vol % | 25 | 30 |
| Kinematic Viscosity at 30° C. cSt | 4.0 | 45 |

*Topped crude oil refers to oil obtained by cutting off the gasoline fraction from Iran heavy crude oil.

TABLE 3

| | Cracked Petroleum heavy oil | Crude Shale Oil | Hydrotreated cracked heavy oil | Hydrotreated shale oil |
|---|---|---|---|---|
| Sepcific Gravity 15/4° C. | 0.915 | 0.910 | 0.861 | 0.862 |
| Elementary Analysis | | | | |
| Carbon wt % | 84.8 | 85.5 | 87.1 | 87.3 |
| Hydrogen wt % | 11.8 | 12.6 | 12.9 | 12.7 |
| Oxygen wt % | 0 | 0.2 | 0 | 0 |
| Nitrogen wt % | 1.0 | 1.1 | 0 | 0 |
| Sulfur wt % | 2.4 | 0.6 | 0 | 0 |
| Composition of Hydrocarbon | | | | |
| Paraffin vol % / Naphthene vol % | 26 | 25 | 55 | 65 |
| Olefin vol % | 20 | 35 | 0 | 0 |
| Aromatics vol % | 54 | 40 | 45 | 35 |
| Kinematic Viscosity at 30° C. cSt | 40 | 16 | 9.8 | 4.4 |

TABLE 4

| | Crude shale oil | Hydrotreated shale oil |
|---|---|---|
| Specific Gravity, 15/4° C. | 0.913 | 0.870 |
| Elementary Analysis | | |
| Carbon wt % | 85.1 | 87.0 |
| Hydrogen wt % | 12.2 | 13.0 |
| Oxygen wt % | 2.2 | 0 |
| Nitrogen wt % | 0.8 | 0 |
| Sulfur wt % | 0.7 | 0 |
| Composition of Hydrocarbon | | |
| Paraffin vol % / Naphthene vol % | 21 | 60 |
| Olefin vol % | 32 | 0 |
| Aromatics vol % | 47 | 40 |
| Kinematic Viscosity at 30° C. cSt | 20 | 6.0 |

EXAMPLE 1

100 g of pulverized brown coal, 95.0% by weight of which passed through a Tyler 100 mesh sieve, 94 ml of A-type fuel oil and 6 ml of 1-dodecene as the olefinic hydrocarbon were put in a 300 cc beaker, and they were mixed with stirring for about 10 minutes by a stirrer equipped with a screw rotor to obtain COM A. On the other hand, for comparison, 100 g of the above-described pulverized brown coal was mixed with 97 ml of A-type fuel oil and 3 ml of 1-dodecane with stirring in the same manner as described above to obtain COM B. Furthermore, 100 g of the above-described pulverized brown coal was mixed with 100 ml of A-type fuel crude oil with stirring in the same manner as described above to obtain COM C, also for comparison.

The degree of precipitation of coal in each example, represented by the unit "gram", was obtained by measuring with using strain gauge the resistance loaded on a measuring steel bar whose top is formed a steel ball having a diameter of 10 mm penetrating into the sample of COM at the rate of 1.0 mm/second. The maximum value in the measured resistances (gram) of the same samples was defined as a maximum resistance. In case that this value is large, the COM cannot be practically used because the pulverized coal precipitates densely. A similar method of measuring this maximum resistance as described above has been reported by Electric Power Development Co., Ltd. in the First International Symposium on Coal Oil Mixture Combustion, held at Florida in the United States in May, 1978.

Properties of the resulting COMs after standing at a room temperature for 3 weeks and 5 weeks are shown in Table 5.

TABLE 5

| | Properties of COM Example 1 | | |
|---|---|---|---|
| | This Invention COM A | Comparison COM B | Comparison COM C |
| Raw materials for mixture | | | |
| Pulverized coal (g) | Brown coal 100 | Brown coal 100 | Brown coal 100 |
| A-type fuel oil (ml) | 94 | 97 | 100 |
| 1-Dodecene (olefin) (ml) | 6 | 3 | 0 |
| State just after production | | | |
| Maximum resistance (g) at 25° C. | 4 | 4 | 4 |
| State after standing at room temperature for 3 weeks | | | |
| Maximum resistance (g) at 25° C. | 20 | 65 | 100 |
| State after standing at room temperature for 5 weeks | | | |
| Maximum resistance (g) at 25° C. | 30 | 120 | 180 |

EXAMPLE 2

100 g of pulverized bituminous coal, 83.8% by weight of which passed through a Tyler 100 mesh sieve, 94 ml of topped crude oil and 6 ml of 1-dodecene as the olefinic hydrocarbon were placed in a 300 cc beaker, and were mixed with stirring for about 10 minutes using a stirrer equipped with a screw rotor to obtain COM D. On the other hand, for comparison, 100 g of the above-described pulverized bituminous coal was mixed with 97 ml of topped oil and 3 ml of 1-dodecene with stirring by the same manner as described above to obtain COM E. Furthermore, 100 g of the above-described bituminous coal was mixed with 100 ml of the topped oil with stirring by the same manner as described above to obtain COM F, also for comparison. Properties of the resulting COMs after standing at a room temperature for 3 weeks and 5 weeks are shown in Table 6.

TABLE 6

| | Properties of COM Example 2 | | |
|---|---|---|---|
| | This Invention COM D | Comparison COM E | Comparison COM F |
| Raw materials for mixture | | | |
| Pulverized coal (g) | Bituminous coal 100 | Bituminous coal 100 | Bituminous coal 100 |
| Topped crude oil (ml) | 94 | 97 | 100 |
| 1-Dodecene (olefin) (ml) | 6 | 3 | 0 |
| State just after production | | | |
| Maximum resistance (g) at 25° C. | 5 | 5 | 5 |
| State after standing at room temperature for 3 weeks | | | |
| Maximum resistance (g) at 25° C. | 15 | 40 | 50 |
| State after standing at room temperature for 5 weeks | | | |
| Maximum resistance (g) at 25° C. | 28 | 80 | 100 |

EXAMPLE 3

100 g of pulverized brown coal 95.0% by weight of which passed through a Typer 100 mesh sieve and 100 ml of heavy cracked oil obtained by cracking asphalt were put in a 300 cc beaker and they were mixed for about 10 minutes using a stirrer equipped with a screw rotor to obtain COM G.

On the other hand, for comparison, 100 g of the above-described brown coal and 100 ml of heavy cracked oil which was subjected to hydrogenation treatment were mixed with stirring by the same manner as described above to obtain COM H. Properties of the resulting COMs after standing at a room temperature for 3 weeks and 5 weeks are shown in Table 7.

EXAMPLE 4

100 g of pulverized brown coal 95.0% by weight of which passed through a Tyler 100 mesh sieve and 100 ml of crude shale oil (shown in Table 3) were put in a 300 cc beaker, and they were mixed for about 10 minutes with stirring by a stirrer equipped with a screw rotor to obtain COM I. On the other hand, for comparison, 100 g of the above-described brown coal was mixed with 100 ml of hydrotreated shale oil which was subjected to hydrogenation treatment with stirring by the same manner as described above to obtain COM J. Properties of the resulting COMs after standing at a room temperature for 3 weeks and 5 weeks are shown in Table 7.

TABLE 7

| | Properties of COM Example 3 | | Example 4 | |
|---|---|---|---|---|
| | This Invention COM G | Comparison COM H | This Invention COM I | Comparison COM J |
| Raw materials for mixture | | | | |
| Pulverized coal (g) | Brown coal 100 | Brown coal 100 | Brown coal 100 | Brown coal 100 |
| Hydrocarbon Oil (ml) | Cracked petroleum heavy oil 100 | Hydrotreated cracked petroleum heavy oil 100 | Crude shale oil 100 | Hydrotreated shale oil 100 |
| Olefin content (vol %) | 20 | 0 | 35 | 0 |
| State just after production | | | | |
| Maximum resistance (g) at 25° C. | 4.5 | 4 | 4 | 4 |
| State after standing at room temperature for 3 weeks | | | | |
| Maximum resistance (g) at 25° C. | 17 | 120 | 19 | 360 |
| State after standing | | | | |

TABLE 7-continued

| | Properties of COM | | | |
|---|---|---|---|---|
| | Example 3 | | Example 4 | |
| | This Invention COM G | Comparison COM H | This Invention COM I | Comparison COM J |
| at room temperature for 5 weeks | | | | |
| Maximum resistance (g) at 25° C. | 26 | 200 | 28 | more than 2,000 |

Further, 100 g of the above-described pulverized brown coal was mixed with 94 ml of A-type fuel oil and 6 ml of 1-dodecene with stirring by the same manner as described above to obtain COM D'.

Moreover, 100 g of the above-described pulverized brown coal was mixed with 100 ml of A-type fuel oil with stirring by the same manner as described above to obtain COM E'.

Properties of the resulting COMs after standing at a room temperature for 3 weeks and 5 weeks are shown in Table 8.

TABLE 8

| | Example 5 | | | | |
|---|---|---|---|---|---|
| | This Invention COM A' | Comparison COM B' | Comparison COM C' | Comparison COM D' | Comparison COM E' |
| Raw materials for mixture | | | | | |
| Pulverized coal (g) | Brown coal 100 | Brown coal 100 | Brown coal 100 | Brown coal 100 | Brown coal 100 |
| Hydrocarbon Oil | A-type fuel oil, 1-Dodecene | A-type fuel oil, 1-Dodecene | A-type fuel oil, 1-Dodecene | A-type fuel oil, 1-Dodecene | A-type fuel oil |
| Organic oxygen content | 0.6 | 0.6 | 0.3 | 0 | 0 |
| Olefin content in oil (% by volume) | 6.0 | 0.6 | 3.0 | 6.0 | 0 |
| State just after production, | | | | | |
| Maximum resistance (g) at 25° C. | 4 | 4 | 4 | 4 | 4 |
| State after standing at room temperature for 3 weeks | | | | | |
| Maximum resistance (g) at 25° C. | 13 | 18 | 30 | 20 | 100 |
| State after standing at room temperature for 5 weeks | | | | | |
| Maximum resistance (g) at 25° C. | 20 | 26 | 42 | 30 | 180 |

It is clear from Tables 5, 6 and 7 that the COMs according to the present invention have excellent stability, and do not solidify after being allowed to stand for a long period of time, as compared with comparative examples wherein hydrocarbon oils not containing olefinic hydrocarbons are used.

EXAMPLE 5

100 g of pulverized brown coal 95.0% by weight of which passed through a Tyler 100 mesh sieve, 94 ml of a hydrocarbon oil containing organic oxygen which was prepared by conducting liquid phase oxidation of a mixture composed of 94 parts by volumes of A-type fuel oil and 6 parts by volume of 1-dodecene as the olefinic hydrocarbon by using air at the reaction temperature of 100° C. for 6 hours and 6 ml of 1-dodecene, were put in a 300 cc beaker, and they were mixed with stirring for about 10 minutes by a stirrer equipped with a screw rotor to obtain COM A'.

On the other hand, for comparison, 100 g of the pulverized brown coal and 100 ml of oil which was prepared by liquid phase oxidation of a mixture composed of 94 parts by volume of A-type fuel oil and 6 parts by volume of 1-dodecene by the same manner as described above were mixed with stirring to obtain COM B'.

Further, 100 g of the above-described pulverized brown coal and 97 ml of oil which was prepared by liquid phase oxidation of hydrocarbon oil obtained by mixing 97 parts by volume of A-type fuel oil and 3 parts by volume of 1-dodecene by the same manner as described above and adding then 3 ml of 1-dodecene were mixed with stirring to obtain COM C'.

EXAMPLE 6

100 g of pulverized bituminous coal 83.8% by weight of which passed through a Tyler 100 mesh sieve and 85 ml of oil which was prepared by liquid phase oxidation of hydrocarbon oil obtained by mixing 85 parts by volume of the topped oil and 15 parts by volume of 1-dodecene as the olefinic hydrocarbon at 100° C. for the reaction temperature for 6 hours and adding then 15 ml of 1-dodecene were put in a 300 cc beaker, and they were mixed with stirring for about 10 minutes by a stirrer equipped with a screw rotor to obtain COM F'.

Further, 100 g of the above-described pulverized bituminous coal, 79 ml of the topped oil, 6 ml of oxidation #10 extract oil obtained by oxidation of #10 extract oil by-produced from an apparatus for purifying solvent for lubricant oil in a petroleum refining plant (furfural process) under application of ultraviolet rays, and 15 ml of 1-dodecene were mixed with stirring in the same manner as described above to obtain COM G'.

On the other hand, for comparison, 100 g of the above-described pulverized bituminous coal was mixed with 92 ml of the topped oil and 8 ml of the above-described oxidation #10 extract oil with stirring in the same manner as described above to obtain COM H'.

Further, 100 g of the above pulverized bituminous coal was mixed with 90 ml of the topped oil and 10 ml of 1-dodecene with stirring in the same manner as described above to obtain COM I'.

Further, 100 g of the above-described pulverized bituminous coal was mixed with 100 ml of the topped oil with stirring in the same manner as described above to obtain COM J'.

Properties of the resulting COMs after standing at a room temperature for 3 weeks and 5 weeks are shown in Table 9.

TABLE 9

| | Example 6 | | | | |
|---|---|---|---|---|---|
| | This Invention COM F' | This Invention COM G' | Comparison COM H' | Comparison COM I' | Comparison COM J' |
| Raw materials for mixture | | | | | |
| Pulverized coal (g) | Bituminous coal 100 | Bituminous coal 100 | Bituminous coal 100 | Bituminous coal 100 | Bituminous coal 100 |
| Hydrocarbon Oil | Topped crude oil, 1-Dodecene | Topped crude oil, 1-Dodecene, Oxidized #10 extract oil | Topped crude oil, Oxidized #10 extract oil | Topped crude oil, 1-Dodecene | Topped crude oil |
| Organic oxygen content in oil (% by weight) | 1.1 | 0.5 | 0.7 | 0 | 0 |
| Olefin content in oil (% by volume) | 15.0 | 15.0 | 0 | 10.0 | 0 |
| State just after production, | | | | | |
| Maximum resistance (g) at 25° C. | 7 | 7 | 7 | 5 | 5 |
| State after standing at room temperature for 3 weeks | | | | | |
| Maximum resistance (g) at 25° C. | 10 | 15 | 20 | 14 | 50 |
| State after standing at room temperature for 5 weeks | | | | | |
| Maximum resistance (g) at 25° C. | 17 | 20 | 35 | 29 | 100 |

EXAMPLE 7

100 g of pulverized brown coal 95.0% by weight of which passed through a Tyler 100 mesh sieve, 92 ml of mixed oil which was prepared by mixing A-type fuel oil with an olefinic hydrocarbon rich fraction having an initial boiling point of about 150° C. or more, obtained by distillation of heavy cracking oil of asphalt, as the olefinic hydrocarbon, so as to be 15% by volume of the olefin content, and 8 ml of oxidized #10 extract oil obtained by oxidation of #10 extract oil by-produced from solvent extraction plant for lubricant oil (furfural process) under application of ultraviolet rays were put in a 300 cc beaker, and they were mixed with stirring for about 10 minutes by a stirrer equipped with a screw rotor to obtain COM K'.

Further, 100 g of the above-described pulverized brown coal was mixed with 100 ml of mixed oil prepared in the same manner as described above with stirring in the same manner to obtain COM L'.

Properties of the resulting COMs after standing at a room temperature for 3 weeks and 5 weeks are shown in Table 10 together with a comparative example.

TABLE 10

| | Example 7 | | |
|---|---|---|---|
| | This Invention COM K' | Comparison COM L' | Comparison COM E' |
| Raw materials for mixture | | | |
| Pulverized coal (g) | Brown coal 100 | Brown coal 100 | Brown coal 100 |
| Hydrocarbon Oil | A-type fuel oil, Cracked heavy oil, Oxidized #10 extract oil | A-type fuel oil, Cracked heavy oil | A-type fuel oil |
| Organic oxygen content in oil (% by weight) | 0.7 | 0 | 0 |
| Olefin content in oil | | | |

TABLE 10-continued

| | Example 7 | | |
|---|---|---|---|
| | This Invention COM K' | Comparison COM L' | Comparison COM E' |
| (% by volume) | 15.0 | 15.0 | 0 |
| State just after production | | | |
| Maximum resistance (g) at 25° C. | 6 | 4 | 4 |
| State after standing at room temperature for 3 weeks | | | |
| Maximum resistance (g) at 25° C. | 12 | 18 | 100 |
| State after standing at room temperature for 5 weeks | | | |
| Maximum resistance (g) at 25° C. | 18 | 23 | 180 |

EXAMPLE 8

100 g of pulverized brown coal 95.0% by weight of which passed through a Tyler 100 mesh sieve and 100 ml of shale oil (crude shale oil) as shown in Table 4 were put in a 300 cc beaker, and they were mixed with stirring for about 10 minutes by a stirrer equipped with a screw rotor to obtain COM M'.

On the other hand, for comparison, 100 g of the above-described pulverized brown coal was mixed with 100 ml of hydrogenated shale oil with stirring by the same manner as described above to obtain COM N'.

Properties of the resulting COMs after standing at a room temperature for 3 weeks and 5 weeks are shown in Table 11.

TABLE 11

| | Example 8 | |
|---|---|---|
| | This Invention COM M' | Comparison COM N' |
| Raw materials for mixture | | |
| Pulverized coal (g) | Brown coal | Brown coal |

TABLE 11-continued

| | Example 8 | |
|---|---|---|
| | This Invention COM M' | Comparison COM N' |
| | 100 | 100 |
| Hydrocarbon Oil | Crude shale oil | Hydrotreated shale oil |
| Organic oxygen content in oil (% by weight) | 2.2 | 0 |
| Olefin content in oil (% by volume) | 32 | 0 |
| State just after production | | |
| Maximum resistance (g) at 25° C. | 4 | 4 |
| State after standing at room temperature for 3 weeks | | |
| Maximum resistance (g) at 25° C. | 12 | 310 |
| State after standing at room temperature for 5 weeks | | |
| Maximum resistance (g) at 25° C. | 16 | more than 2,000 |

It is clear from Tables 8, 9, 10 and 11 that the COMs according to the present invention have excellent stability, and do not solidify after being allowed to stand for a long period of time, as compared with comparative examples wherein hydrocarbon oils not containing olefinic hydrocarbons and organic oxygen are used.

EXAMPLE 9

100 g of pulverized delayed coke 95.0% by weight of which passed through a Tyler 100 mesh sieve, 85 ml of oil which was prepared by liquid phase oxidation of hydrocarbon oil obtained by mixing 85 parts by volume of the topped oil and 15 parts by volume of 1-dodecene as the olefinic hydrocarbon at 100° C. for the reaction temperature for 6 hours and 15 ml of 1-dodecene were put in a 300 cc beaker, and they were mixed with stirring for about 10 minutes by a stirrer equipped with a screw rotor to obtain COM O'.

Further, 50 g of the above-described pulverized delayed coke, 50 g of pulverized brown coal 95% by weight of which passed through a Tyler 100 mesh sieve, 85 ml of oil which was prepared by liquid phase oxidation of hydrocarbon oil obtained by mixing 85 parts by volume of the topped oil and 15 parts by volume of 1-dodecene as the olefinic hydrocarbon at 100° C. for the reaction temperature for 6 hours and 15 ml of 1-dodecene were put in a 300 cc beaker, and they were mixed with stirring for about 10 minutes by a stirrer equipped with a screw rotor to obtain COM P'.

Further, 100 g of the above-described pulverized delayed coke was mixed with 100 ml of the topped oil with stirring in the same manner as described above to obtain COM Q'.

Further, 50 g of the above-described pulverized delayed coke, 50 g of the above-described pulverized brown coal were mixed with 100 ml of the topped oil with stirring in the same manner as described above to obtain COM R'.

Properties of the resulting COMs after standing at a room temperature for 3 weeks and 5 weeks are shown in Table 12.

TABLE 12

| | Example 9 | | | |
|---|---|---|---|---|
| | This Invention COM O' | This Invention COM P' | Comparison COM Q' | Comparison COM R' |
| Raw materials for mixture | | | | |
| Pulverized Coal or petroleum coke (g) | Delayed coke 100 | Delayed coke 50 Brown coal 50 | Delayed coke 100 | Delayed coke 50 Brown coal 50 |
| Hydrocarbon oil | Topped crude-oil, 1-Dodecene | Topped crude-oil, 1-Dodecene | Topped crude-oil, | Topped crude-oil, |
| Organic oxygen content in oil (% by weight) | 1.1 | 1.1 | 0 | 0 |
| Olefin content in oil (% by volume) | 15.0 | 15.0 | 0 | 0 |
| State just after production, | | | | |
| Maximum resistance (g) at 25° C. | 7 | 7 | 5 | 5 |
| State after standing at room temperature for 3 weeks | | | | |
| Maximum resistance (g) at 25° C. | 10 | 10 | 42 | 46 |
| State after standing at room temperature for 5 weeks | | | | |
| Maximum resistance (g) at 25° C. | 16 | 17 | 85 | 92 |

EXAMPLE 10

55 ml of oil which was prepared by liquid phase oxidation of hydrocarbon oil obtained by mixing 85 parts by volume of the topped oil and 15 parts by volume of 1-dodecene as the olefinic hydrocarbon at 100° C. for the reaction temperature for 6 hours, 15 ml of 1-dodecene and 30 ml of water were put in a 300 cc beaker, and they were mixed with stirring for about 10 minutes by a stirrer equipped with a screw rotor to obtain an emulsion oil.

Further, 100 g of pulverized bituminous coal 83.8% by weight of which passed through a Tyler 100 mesh sieve and 100 ml of the above-described emulsion oil were mixed with stirring for about 10 minutes by a stirrer equipped with a screw rotor to obtain COM S'.

On the other hand, for comparison, 100 g of the above-described pulverized bituminous coal was mixed with 100 ml of the topped oil with stirring in the same manner as described in Example 6.

Properties of the resulting COM after standing at a room temperature for 3 weeks and 5 weeks are shown in Table 13.

TABLE 13

| | Example 10 This Invention COM S' |
|---|---|
| Raw materials for mixture | |
| Pulverized coal (g) | Bituminous coal 100 |
| Hydrocarbon oil | Topped crude oil 1-Dodecene |
| Organic oxygen content in oil (% by weight) | 1.1 |
| Olefin content in oil (% by volume) | 15 |
| Water content in oil (% by volume) | 30 |
| State just after production, | |
| Maximum resistance (g) at 25° C. | 9 |
| State after standing at room temperature for 3 weeks | |
| Maximum resistance (g) at 25° C. | 10 |
| State after standing at room temperature for 5 weeks | |
| Maximum resistance (g) at 25° C. | 15 |

EXAMPLE 11

The COM (i.e., COM T', COM U', COM V' and COM W') having each composition as shown in Table 14 was burnt using a rotary burner in an adiabatic horizontal cylindrical furnace having a furnace capacity of 2.0 $m^3$ to measure a content of nitrogen oxide contained in the flue gas. The results are shown in Table 14.

TABLE 14

| Properties of COM and Burning Test Results | Example 11 | | | |
|---|---|---|---|---|
| | This Invention COM T' | Comparison COM U' | This Invention COM V' | Comparison COM W' |
| Raw materials for mixture | | | | |
| Pulverized coal (g) | Brown Coal 40 | Brown coal 40 | Brown coal 40 | Brown coal 40 |
| Hydrocarbon oil | A-type fuel oil 79 ml<br>1-Dodecene 15 ml<br>Oxidized #10 extract oil 6 ml | A-type fuel oil 79 ml<br>1-Dodecene 15 ml<br>Oxidized #10 extract oil 6 ml | Crude shale oil (shown in Table 4) 100 ml | Crude shale oil (shown in Table 4) 100 ml |
| Water content (% by volume) | 30 | 0 | 30 | 0 |
| NO × content of flue gas, ppm (dry base) @ $O_2$ = 4% | 250 | 387 | 280 | 520 |

It is clear from the results of Table 14 that the emulsified COMs containing water in this invention have an excellent reduction effect of reducing a nitrogen oxide content in the flue gas as compared with the COMs of the comparison.

While the invention has been described in detail and with reference to specific embodiments thereof, it will be apparent to one skilled in the art that various changes and modifications can be made therein without departing from the spirit and scope thereof.

What is claimed is:

1. A coal-oil mixture comprising pulverized coal dispersed in hydrocarbon oil containing olefinic hydrocarbons having at least 8 carbon atoms in an amount of at least 5% by volume, based on the total volumes of the hydrocarbon oil and the olefin.

2. A coal-oil mixture as in claim 1 comprising pulverized coal dispersed in hydrocarbon oil containing at least 5% by volume olefinic hydrocarbons having at least 8 carbon atoms and containing at least 0.5% by weight organic oxygen.

3. A coal-oil mixture as in claim 1 or 2 wherein said hydrocarbon oil is obtained from oil shale.

4. A coal-oil mixture as in claim 1 wherein said hydrocarbon oil is obtained by adding olefinic hydrocarbons having at least 8 carbon atoms to petroleum fuel oil.

5. A coal-oil mixture as in claim 2 wherein said hydrocarbon oil is obtained by adding olefinic hydrocarbons having at least 8 carbon atoms and organic oxygen to petroleum fuel oil.

6. A coal-oil mixture as in claim 4 wherein said hydrocarbon oil is obtained by adding olefinic hydrocarbons prepared from oil shale to petroleum fuel oil.

7. A coal-oil mixture as in claim 5 wherein said hydrocarbon oil is obtained by adding olefinic hydrocarbons and organic oxygen prepared from oil shale to petroleum fuel oil.

8. A coal-oil mixture as in claim 1 or 2 wherein said hydrocarbon oil is obtained by cracking or reforming heavy oil.

9. A coal-oil mixture as in claim 1 wherein said hydrocarbon oil is obtained from oil sand.

10. A coal-oil mixture as in claim 4 wherein said hydrocarbon oil is obtained by adding olefinic hydrocarbon prepared from oil sand to petroleum fuel oil.

11. A coal-oil mixture as in claim 1, 2, 4, 5, 6, 7, 9 or 10 wherein said hydrocarbon oil is obtained by adding 2 to 100 parts of water to 100 parts by volume of the hydrocarbon oil.

12. A coal-oil mixture as in claim 4 or 5 wherein said olefinic hydrocarbons have 10 or more carbon atoms and an initial boiling point of higher than 150° C.

13. A coal-oil mixture as in claim 1 or 2 wherein said hydrocarbon oil contains at least 10% by volume olefinic hydrocarbons having at least 8 carbon atoms.

14. A coal-oil mixture as in claim 4 or 5 wherein said hydrocarbon oil is obtained by adding the olefinic hydrocarbons in an amount of at least 10% by volume.

15. A coal-oil mixture as in claim 1, 2, 4, 5, 6, 7, 9 or 10 wherein the pulverized coal has an average particle diameter of 100μ or less, and at least 80% of which particles pass through a Tyler 100 mesh sieve.

16. A coal-oil mixture as in claim 1, 2, 4, 5, 6, 7, 9 or 10 wherein the pulverized coal is a pulverized petroleum coke.

17. A coal-oil mixture as in claim 1, 2, 4, 5, 6, 7, 9 or 10 wherein the pulverized coal is a mixture of the pulverized coal and a pulverized petroleum coke.

* * * * *